US006131696A

United States Patent [19]

Esslinger

[11] Patent Number: 6,131,696

[45] Date of Patent: Oct. 17, 2000

[54] MULTIPLE INLET MUFFLER

[76] Inventor: Thomas H. Esslinger, P.O. Box 58, Cheshire Turnpike, Alstead, N.H. 03602

[21] Appl. No.: 09/075,893

[22] Filed: May 11, 1998

[51] Int. Cl.[7] ..... E04F 17/04

[52] U.S. Cl. ..... 181/224; 181/238; 181/270

[58] Field of Search ..... 181/224, 229, 181/238, 239, 252, 256, 258, 269, 270, 282

[56] References Cited

U.S. PATENT DOCUMENTS

| | | | |
|---|---|---|---|
| 3,702,644 | 11/1972 | Fowler, Jr. et al. | 181/224 |
| 3,841,434 | 10/1974 | Culpepper, Jr. | 181/224 |
| 4,346,780 | 8/1982 | Packshies et al. . | |
| 4,821,839 | 4/1989 | D'Antonio et al. . | |
| 5,244,521 | 9/1993 | Ligman . | |
| 5,563,382 | 10/1996 | Choyce . | |

*Primary Examiner*—Khanh Dang

*Attorney, Agent, or Firm*—Christopher E Blank

[57] ABSTRACT

A compressed gas muffler that accommodates multiple sources and removes back-pressure to the source has a housing with a top, a bottom, and four sides. An inlet has a lip and an open center. The lip extends from the top of the housing. The open center extends from the lip through the top of the housing. A plurality of sound-absorbent baffles are disposed inside the housing. Baffles lay parallel to each other and project from opposite sides of the housing. An open space of uniform size is maintained between the baffles. An outlet extends along the width of one side of the housing. The outlet is located on one side and near the bottom of the housing. A tube fits around the lip of the inlet. The tube is used to vent compressed gas from its source to the muffler. Compressed gas flows out of the tube, through the inlet, and into the housing. Compressed gas continues to flow through the open space between the baffles. As the air flows through the open space, noise is absorbed by the baffles. Compressed gas exits the housing through the outlet. The outlet is significantly larger than the inlet, eliminating both back pressure and exit noise from the gas.

1 Claim, 3 Drawing Sheets

MULTIPLE INLET MUFFLER

FIELD OF THE INVENTION

The present invention relates to noise reduction, and more particularly to reducing noise created by pressurized gas.

BACKGROUND OF THE INVENTION

Various types of silencing devices have been used to reduce or eliminate noise created when compressed gas is vented. Often, the compressed gas is being vented from a machine in an industrial setting. The noise that vented gas makes is harmful to the human ear and can cause hearing loss over time, creating a health hazard for workers.

One method of noise reduction of compressed gas is disclosed in U.S. Pat. No. 4,346,780. Here, pressurized gas is removed from pipes while the pipes under-go a zinc plating process. A purging device consists of a receptacle, a mouthpiece, and a placement means. The receptacle is a housing with a top, a bottom, at least two sides, and a substantially empty interior. The receptacle has an inlet port in one side, and an outlet port through the top of the receptacle. A deflection sheet extends from the top of the housing into the interior. A flexible curtain is suspended in the interior of the housing, and hangs vertically from the deflection sheet. A noise attenuator is placed at one end of the outlet port, opposite the top of the housing.

A mouthpiece has two open ends. One open end attaches to the housing at the inlet port, such that an open path exists from the mouthpiece, through the housing into the interior. A placement means is positioned on the outside of the housing and holds the mouthpiece.

A pipe is fitted into the mouthpiece. Steam is blown through the pipe. The vapors flow through the pipe, into the mouthpiece, and further into the interior of the receptacle. Vapors contact the deflection sheet, and flow down the length of the flexible curtain toward the bottom of the housing. Vapors continue to flow under the flexible curtain, and upwards along the length of the flexible curtain, toward the outlet port. Vapors then exit the housing through the outlet port, then flowing through the noise attenuator.

This configuration is disadvantageous noise reduction for several reasons. First, the receptacle can only accommodate one pipe at a time. Each plating station would require its own purge. Also, each time a new pipe is purged, the purging equipment must be disconnected from the plated pipe and reconnected to the new pipe requiring plating, slowing down the over-all production time. Furthermore, the purging device also is detrimental because it can create back-pressure. The compressed gas must be blown through the pipe by a fan. The short flow path and small noise attenuator allow back pressure to build up in the receptacle.

A sound diffuser is disclosed in U.S. Pat. No. 4,821,839. The diffuser has a housing with a top and a bottom. Sound-absorbing panels are constructed at different heights. The panels sit upright inside the housing and are attached to the bottom of the housing. Noise enters one end of the diffuser and travels over the panels toward the other end. As noise passes over the panels, it is absorbed.

While the sound diffuser incorporates sound-absorbing techniques, it is not adapted for use in an industrial environment. Specifically, this diffuser has no mechanisms or features that accommodate compressed gas removal. Also, the diffuser only accommodates one noise source.

A method for muffling compressed air from pneumatic tools is disclosed in U.S. Pat. No. 5,233,521. This method uses heat shrink tubing. A pneumatic tool exhausts compressed gas. Heat shrink tubing is disposed around the pneumatic tool. The tubing is then shrunk to fit the tool. When shrinking, a space is left between the tool and the tubing, leaving a passageway for the compressed gas to flow through. As the compressed gas flows away from the tool through the passageway, the heat shrink tubing also absorbs noise made by the compressed gas.

While this method removes compressed gas and absorbs noise, it is specifically adapted to pneumatic tools. Using heat shrunk tubing is only practical when the noise source is small. Also, heat shrunk tubing must be removed and reapplied each time the tool might need repair or maintenance work.

Another compressed air silencer is disclosed in U.S. Pat. No. 5,563,382. The silencer has a housing, with a top end, a bottom end, and four sides. An inlet port creates an open path through one side of the housing. An outlet port creates an open path through one side of the housing and is located at the side opposite the inlet port. Singular-piece baffles extend from the housing toward the open path. A silencing tube has a contained end and a free end. The contained end sits inside the outlet port, extending into the housing. The free end extends away from the housing.

A pipe expelling compressed gas fits into the inlet port. Compressed gas flows over the baffles. Noise is absorbed by the baffles during this flow. Gas exits the housing through the silencing tube, which provides further attenuation.

This silencer is disadvantageous. First, it can only accommodate one noise source at a time. Also, the small diameter of the outlet tube creates back-pressure at the exit, decreasing efficiency of the system and introducing a new noise source.

SUMMARY OF THE INVENTION

The present invention provides a compressed gas muffler that accommodates multiple sources and removes back-pressure to the source.

According to the invention the muffler has a housing with a top, a bottom, and four sides. An inlet has a lip and an open center. The lip extends from the top of the housing. The open center extends from the lip through the top of the housing. A plurality of sound-absorbent baffles are disposed inside the housing. Baffles lay parallel to each other and project from opposite sides of the housing. An open space of uniform size is maintained between the baffles. An outlet extends along the width of one side of the housing. The outlet is located on one side and near the bottom of the housing.

A tube fits around the lip of the inlet. The tube is used to vent compressed gas from its source to the muffler. Compressed gas flows out of the tube, through the inlet, and into the housing. Compressed gas continues to flow through the open space between the baffles. As the air flows through the open space, noise is absorbed by the baffles. Compressed gas exits the housing through the outlet. The outlet is significantly larger than the inlet, eliminating both back pressure and exit noise from the gas.

Features of the invention include a light-weight and compact-sized muffler. This allows the muffler to be used easily in a factory or assembly line setting. The apparatus is constructed from many off-the-shelf and otherwise inexpensive materials, reducing cost of the individual muffler. Also, each muffler can be used for multiple noise sources, allowing the user to buy less equipment and thus save money. The design also prevents back pressure from being applied to the mechanical system providing the noise source. Back pressure makes the system run less efficiently. Thus the muffler also preserves the integrity of the working machinery.

BRIEF DESCRIPTION OF THE DRAWINGS

Other features and benefits of the invention will be more clearly understood with reference to the specification and the accompanying drawings in which.

DETAILED DESCRIPTION

Figure 1:
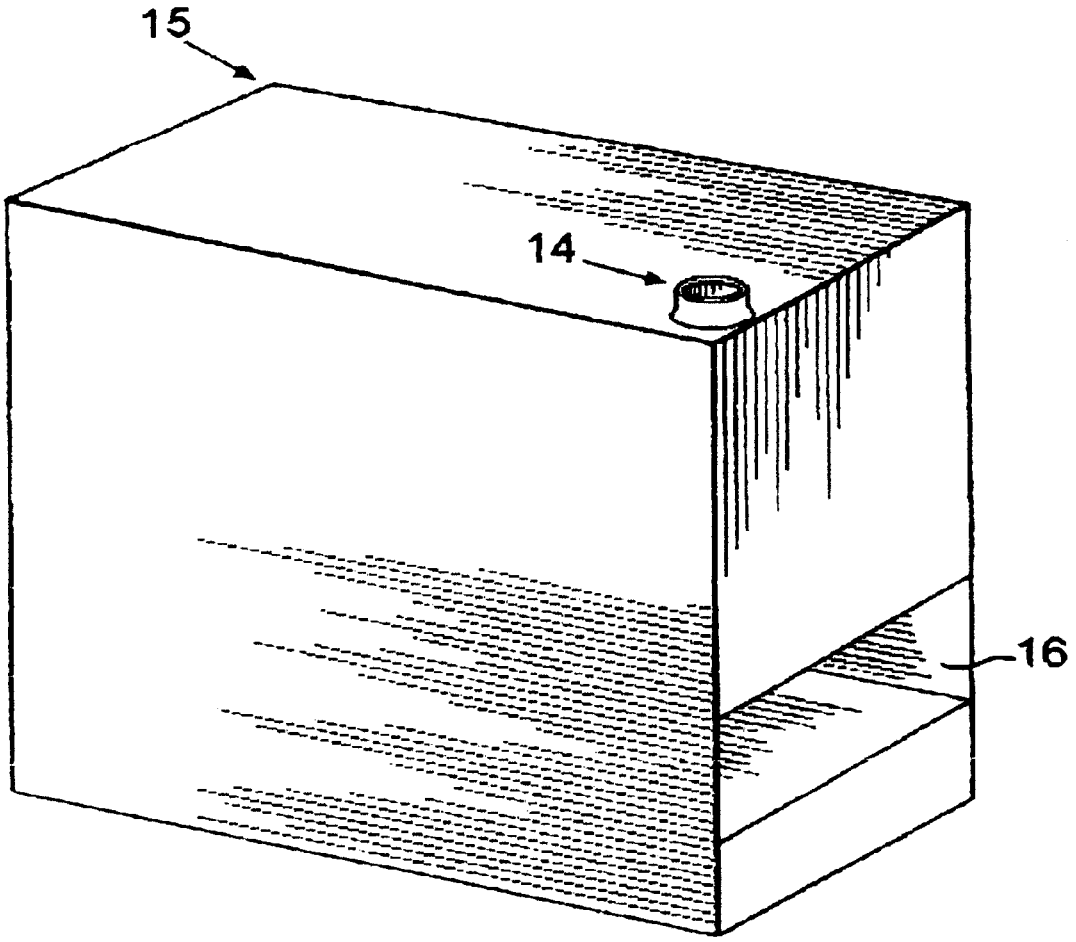
FIG. 1 is an elevation view of the multiple inlet muffler.

A particular embodiment of a multiple inlet muffler 10 is shown in FIG. 1. The muffler 10 is comprised of a housing 12 made from sixteen gauge sheet steel. The housing 12 is rectangular, and has a top, a bottom, four sides, an interior, and an exterior. An inlet 14 is comprised of a lip 16 and an open center 18. At least two inlets 14 are located on top of the housing 12. An outlet 16, with a height of two inches and a width substantially the same as the housing 12, is completely open, and is located in one side and close to the bottom of the housing 12.

Figure 2:
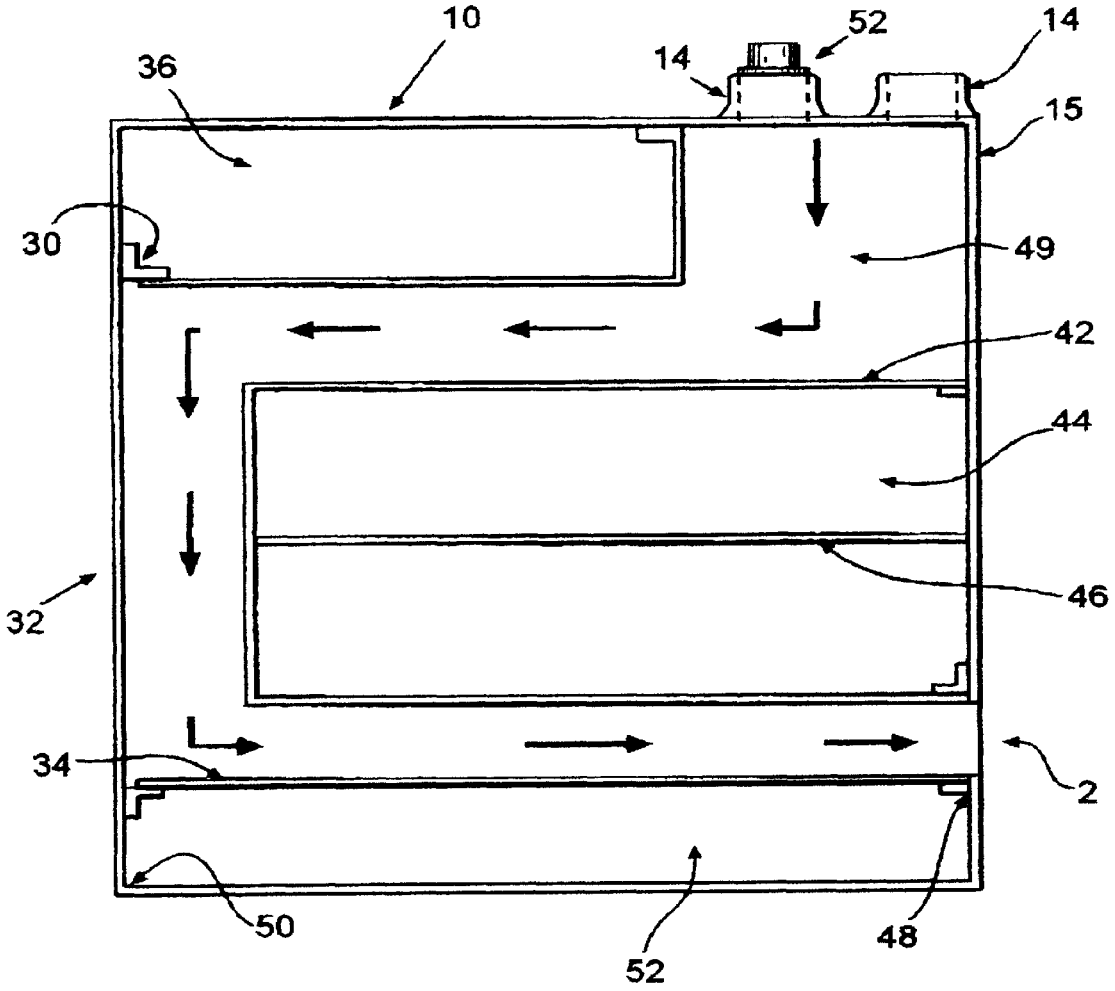
FIG. 2 is a cross-sectional view along line A of the multiple inlet muffler shown in FIG. 1.

A cross-sectional view of the multiple inlet muffler 10 is shown in FIG. 2. A plurality of baffles 24, 26, 28 are disposed in the housing 12 interior. A first baffle 24 is composed of an L-shaped bracket 30, a U-shaped bracket 32, a covering 34, and a filling 36. The L-shaped bracket is made from steel, and welded to a side of the housing 12 furthest from the inlets 14 and approximately three inches away from the top of the housing. The U-shaped bracket 32 is made from steel and welded to the housing such that a side of the bracket is attached to the top of the housing 12 slightly further along the length of the housing 12 than where the inlets 14 are positioned, and a side of the bracket extends to approximately three inches away from the top of the housing 12. A filling 36 of 2 pound per cubic foot acoustical fiberglass is cut to the same rectangular shape formed by the brackets 30 and 32, and layered lengthwise between the brackets 30 and 32, and the top of the housing 12. A covering 34 made from perforated metal that is 28% open is tack-welded to a side of the L-shaped bracket 30 and the U-shaped bracket 32 such that the filling 36 is enclosed. The first baffle 24 formed is a rectangular shape with approximately a three inch height, a width approximately equal to the width of the housing 12, and a length extending from the farthest end of the housing and ending such that an empty space is left below the inlets 14.

A second baffle 26 is comprised of two L-shaped brackets 38, 40, a filling 44, a central layer 46, and a covering 42. A first L-shaped bracket 38, made from steel, is welded to a side of the housing 12 directly below the inlets 14, at a distance of approximately five inches below the top of the housing 12. A second L-shaped bracket 40, made from steel, is welded to the same side of the housing 12 as the first L-shaped bracket 38, and is located approximately six inches below the first L-shaped bracket 38. Similar to the first baffle 24, a filling 44 of the same acoustical fiberglass is cut to fit in layers between the two L-shaped brackets 38, 40. The center layer 46 made from vinyl is placed between the filling 44 such that an even number of layers are on either side of the center layer 46. The covering 42, similar to the covering 34 in the first baffle 24, is made from perforated metal that is 28% open. The covering 42 is cut in a sheet and tack-welded to the first L-shaped bracket 38, extended to cover the length and width of the filling 44, and tack-welded to the second L-shaped bracket 40. The second baffle 26 extends the width of the housing 12 and for a length of thirteen inches, leaving a two inch space between the second baffle 26 and a side of the housing 12.

A third baffle 28 is comprised of two L-shaped brackets 48, 50, a filling 52, and a covering 54. Each L-shaped bracket 48, 50, made from steel is welded to a side of and approximately two inches from the bottom of the housing 12. The filling 52, made from the same acoustical fiberglass as in the first 24 and second 26 baffles, is cut to fit in layers between the bottom of the housing 12 and the L-shaped brackets 48, 50. A covering 54 made from perforated metal that is 28% open, is tack welded to each L-shaped bracket 48, 50, such that the filling 52 is enclosed and the third baffle 28 is flush with the bottom of the outlet 16.

The first 24, second 26, and third 28 baffles are arranged such that a flow path 49 extends from the inlet, between the first 24 and second 26 baffle, along the height of the second baffle 26, between the second 26 and third 28 baffles, and through the outlet 16.

According to the invention, pressurized gas is brought from a source to the multiple inlet muffler 10 through tubing 50 with a half-inch diameter. The tubing 50 is fit over the lip 16 of the inlet 14. Any unused inlets are closed with a cap (52) to maintain gas flow. Gas flows through the open center 18 of the inlet 14, and into the flow path 49. As the pressurized gas flows along the flow path 49, sound waves contact the baffles 24, 26, 28, entering through perforations in the metal making up the coverings 34, 42, 54, and are absorbed by the filling 36, 44, 52. The center layer 46 of the second baffle 26 acts as a barrier, preventing sound waves from passing through the second baffle 26 and not being absorbed. Pressurized gas flows out of the multiple inlet muffler 10 through the outlet 16. The area of the outlet 16 is large in comparison to the area of multiple inlets 14, reducing the gas velocity at its exit point. The decreased gas velocity also prevents exiting gas from creating noise as it passes through the outlet 16. Effective noise absorption is maintained by keeping the total area of the length of the flow path 49 approximately ten times longer than a cross-sectional height of the flow path 49.

Figure 3:
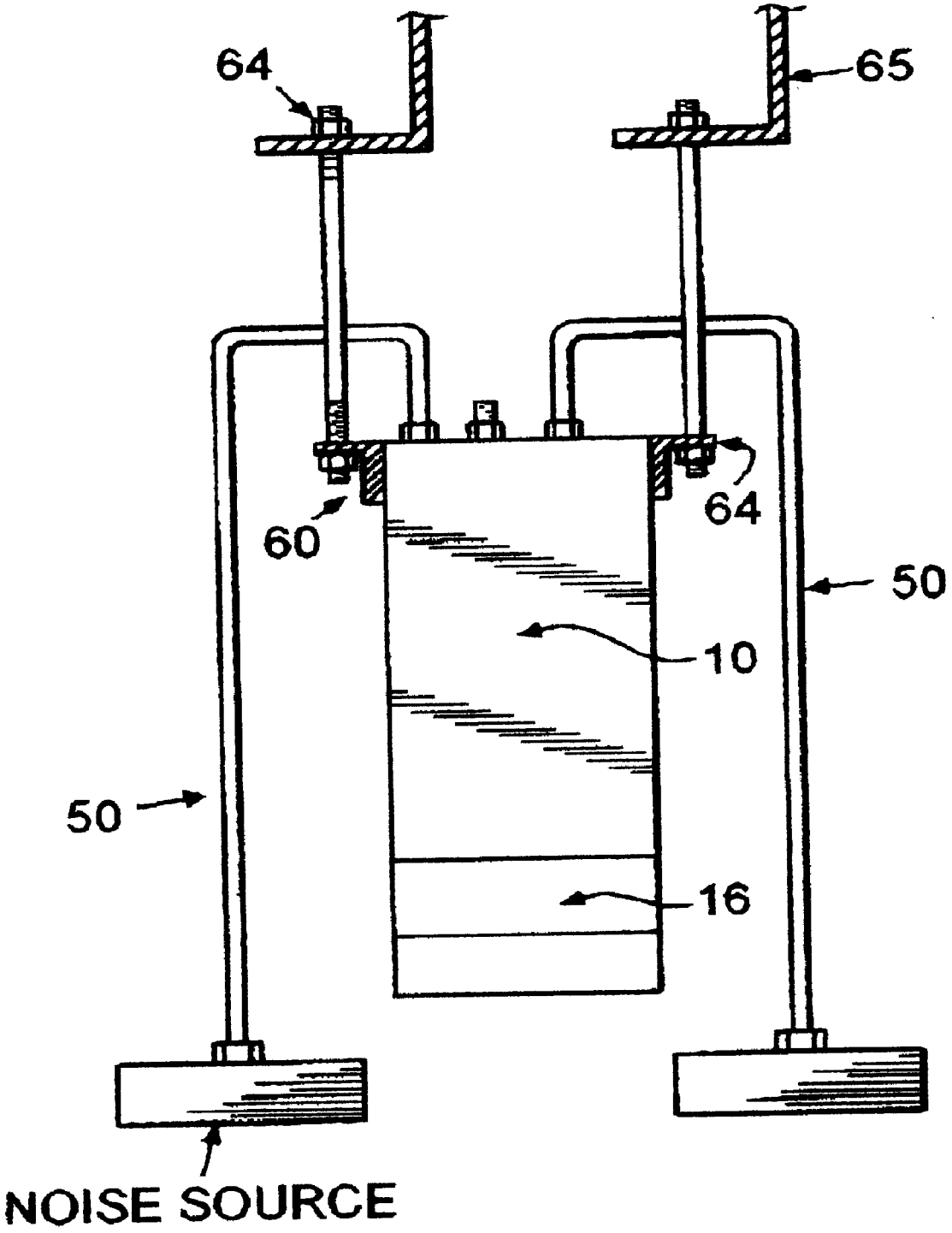
FIG. 3 is a plan view of a specific embodiment of the multiple inlet muffler of FIG. 1.

A specific embodiment of the multiple inlet muffler 10 is shown in FIG. 3, where there is not enough space to locate a multiple inlet muffler on the floor, it may also be suspended from the ceiling. In this embodiment, L-shaped brackets 60 and 62 are welded onto the outside of the housing 12 such that a ledge is formed extending away from the housing 12. Holes are cut through the L-shaped brackets 60, 62. A threaded rod 63 extends from the brackets 60, 62 to a ceiling beam or surface 65. A hole is also cut through the ceiling surface 65. The threaded rod extends through the holes in the brackets 60, 62 and the holes in the ceiling surface 66. A nut 64 is wound onto the threaded rod 63 at each hole to hold the threaded rod 63 and brackets 60, 62 in place. The multiple inlet muffler 10 is thus suspended from the ceiling. Tubing 50 may be attached to the inlets 14 prior to suspension so that tubing may be disconnected from a noise source and reconnected to another noise source as necessary. Also, for any inlets 14 not in use, a plug 52 may be installed prior to suspension.

Although the shape of the housing in the embodiments described is rectangular, it may be appreciated that any shape adapted for conveniently placing the apparatus can be used.

Although the housing described herein is made from sixteen gauge sheet steel, it may be appreciated that other materials adaptable to an industrial setting, including aluminum or stainless steel, can be used.

Although the baffles 24, 26, 28 described herein are rectangular, it will be appreciated that baffles of varied shape and proportion can be used to maintain a flow path 49 area of ten times the largest cross-section area of the flow path 49.

Although the tubing 50 used in this embodiment is made of rubber, tubing made from metallic and non-metallic materials can used.

Although the inlets 14 described herein have a diameter of one inch, both diameter and number or inlets 14 may be varied without increasing the sound absorbing surface are inside the multiple inlet muffler 10. With a diameter of one half inch, nine inlets can be used. With an inlet diameter of either three-fourths of an inch or one inch, eight inlets can be used. With a diameter of one and one-fourth inches, six inlets can be used.

Although the filling 36, 44, 52 described herein is made from fiberglass, other sound-absorbent materials, such as mineral wool or acoustical foam, can be used. It will be appreciated that if acoustical foam is used, a covering 34, 42, 54 will be unnecessary to hold the foam in place.

Although the center layer 46 of the second baffle 26 is made of vinyl having a density of one pound per square foot, materials that have a density of at least one pound per square foot, such as lead, steel, or aluminum, can be used.

Although the covering 34, 42, 54 described herein is made from perforated metal that is 28% open, other open materials with strength sufficient to hold in fiberglass, such as perforated aluminum or fabrics can be used.

Although the invention has been shown and described with respect to specific embodiments, various other changes, omissions, and additions in form and detail thereof may be made therein without departing from the spirit and scope of the invention.

What is claimed is:

1. A noise reduction apparatus comprising:

an enclosure having an exterior and an interior;

at least two inlets allowing a pressurized gas to enter the enclosure;

a plurality of baffles made substantially of acoustic material that are attached to the interior of the enclosure and not touching any other baffle, forming a path for the pressurized gas flow, wherein at least one baffle has a central layer that is able to deflect a noise level up to twenty-six decibels, and an outlet through the exterior of said enclosure.

* * * * *